US007467418B2

(12) United States Patent
Kronenberger

(10) Patent No.: US 7,467,418 B2
(45) Date of Patent: Dec. 23, 2008

(54) KIT AND SYSTEM FOR APPLYING ADORNMENT TO AN APPAREL ARTICLE

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 283 days.

(21) Appl. No.: 11/253,038

(22) Filed: Oct. 18, 2005

(65) Prior Publication Data

US 2006/0143790 A1 Jul. 6, 2006

(51) Int. Cl.
*A41F 9/00* (2006.01)

(52) U.S. Cl. ..... 2/1; 2/209.13; 2/244

(58) Field of Classification Search ..... 2/1, 2/69, 195.1, 209.12, 195.2–195.4, 209.11, 2/171, 171.1, 171.3, 181, 183, 209.4, 209.5; 156/250; 206/575
See application file for complete search history.

(56) References Cited

U.S. PATENT DOCUMENTS

| | | | | | |
|---|---|---|---|---|---|
| 2,088,455 | A | | 7/1937 | Witt | |
| 2,523,130 | A | | 9/1950 | Victor | |
| 2,772,698 | A | | 12/1956 | Linehan, Jr. | |
| 2,799,956 | A | | 7/1957 | Ciroli | |
| 3,438,062 | A | * | 4/1969 | Dobell | 2/247 |
| 3,509,003 | A | * | 4/1970 | Engle | 428/78 |
| 4,774,728 | A | | 10/1988 | Carnicella | |
| 4,776,043 | A | | 10/1988 | Coleman | |
| 4,860,387 | A | * | 8/1989 | Williams | 2/244 |
| 4,975,985 | A | * | 12/1990 | Stimpson | 2/115 |
| 5,052,056 | A | * | 10/1991 | Braun | 2/115 |
| 5,070,545 | A | * | 12/1991 | Tapia | 40/329 |
| 5,086,516 | A | | 2/1992 | Baxter et al. | |
| 5,149,388 | A | * | 9/1992 | Stahl | 156/250 |
| 5,359,734 | A | | 11/1994 | Rathburn | |
| 5,803,266 | A | * | 9/1998 | Blackwelder | 206/575 |
| 5,817,393 | A | | 10/1998 | Stahl | |
| 5,943,702 | A | * | 8/1999 | Kronenberger | 2/171.1 |
| 5,974,997 | A | * | 11/1999 | Amburgey | 112/475.01 |
| 6,519,779 | B1 | * | 2/2003 | Taguchi | 2/209.12 |
| 6,675,512 | B1 | | 1/2004 | Shwartz et al. | |
| 7,137,149 | B2 | * | 11/2006 | Kronenberger | 2/195.1 |

* cited by examiner

*Primary Examiner*—Gary L. Welch
*Assistant Examiner*—Richale L Quinn
(74) *Attorney, Agent, or Firm*—Wood, Phillips, Katz, Clark & Mortimer

(57) ABSTRACT

The combination of: a first apparel article having a sheet layer defining a first exposed surface; a first substrate layer having a perimeter edge; a second substrate layer having a perimeter edge; a first design piece comprising thread that is formed to produce at least a part of a first viewable design and having a perimeter edge; and a second design piece having thread that is formed to produce at least a part of a second viewable design and having a perimeter edge. The first and second design pieces have a different appearance. Each of the first and second design pieces is selectively attachable to the first exposed surface of the first apparel article in relationship to either one of the first and second substrate layers in the same manner such that a selected one of the first and second substrate layers extends beyond the perimeter edge of a selected one of the design pieces to define a frame surface at least partially around the perimeter edge of the selected one of the design pieces.

3 Claims, 4 Drawing Sheets

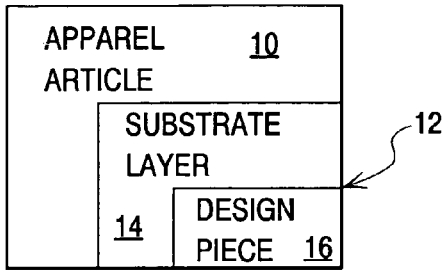
Fig. 1
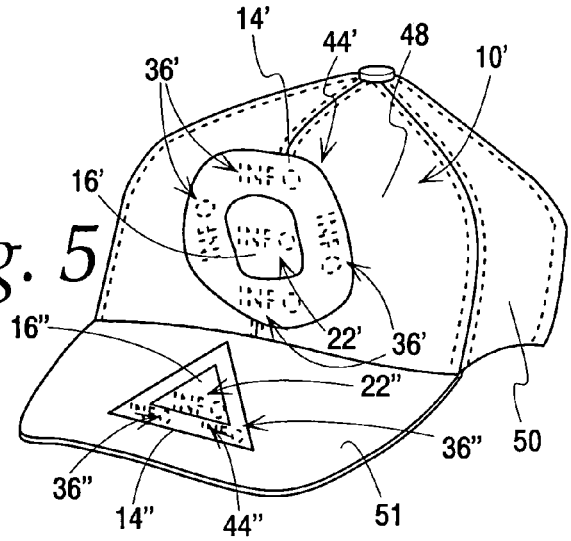
Fig. 5
Fig. 3
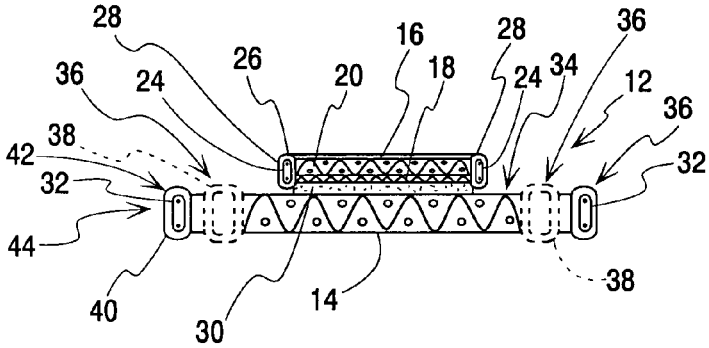
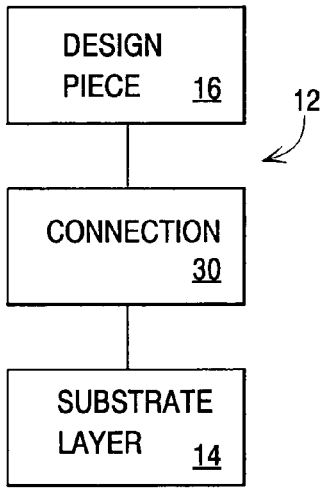
Fig. 4
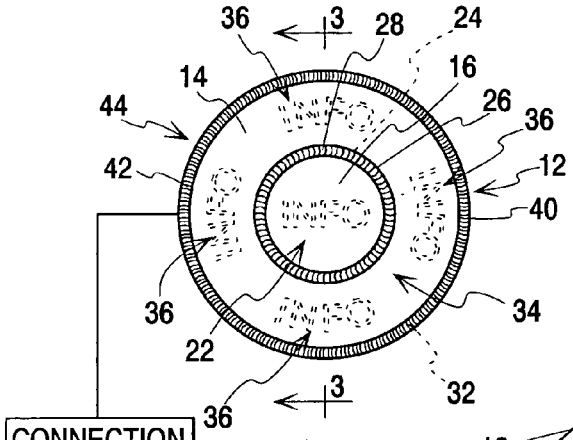
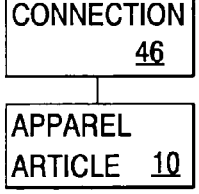
Fig. 2
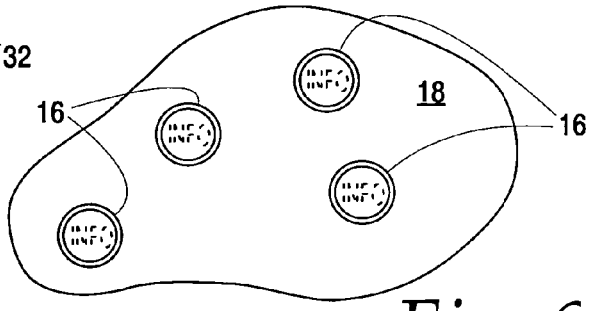
Fig. 6

KIT AND SYSTEM FOR APPLYING ADORNMENT TO AN APPAREL ARTICLE

BACKGROUND OF THE INVENTION

1. Field of the Invention

This invention relates to general apparel and, more particularly, to a kit for coordinatingly applying adornment to the apparel.

2. Background Art

Apparel items such as headwear, shirts, etc., are commonly adorned with self-contained patches that are applied to an exposed surface using adhesive, stitching, etc. Typically, a single patch design will be used for different colored and/or styled apparel pieces. Designers of the adorning patch will normally use an arrangement of colors that makes a single patch generically compatible to a certain degree with all contemplated apparel items. As a result, the coloring on the patch will generally match closely with certain colors/designs on some apparel items and be less than compatible or potentially contrast with others. The result is that the adornment might not optimally complement the look of a significant portion of apparel items with which the ornamental patch is used.

In the highly competitive apparel industry, success in sales may be predicated upon a slight advantage of one entity's goods over another, be it with respect to quality or the appearance thereof. Effective color coordination between ornamental patches and apparel items thus becomes a significant consideration for purveyors of these items.

SUMMARY OF THE INVENTION

In one form, the invention is directed to the combination of: a first apparel article having a sheet layer defining a first exposed surface; a first substrate layer having a perimeter edge; a second substrate layer having a perimeter edge; a first design piece comprising thread that is formed to produce at least a part of a first viewable design and having a perimeter edge; and a second design piece having thread that is formed to produce at least a part of a second viewable design and having a perimeter edge. The first and second design pieces have a different appearance. Each of the first and second design pieces is selectively attachable to the first exposed surface of the first apparel article in relationship to either one of the first and second substrate layers in the same manner such that a selected one of the first and second substrate layers extends beyond the perimeter edge of a selected one of the design pieces to define a frame surface at least partially around the perimeter edge of the selected one of the design pieces.

In one form, the first and second viewable designs are substantially the same but are respectively formed at least in part with first and second thread sections of different color.

The combination may include a second apparel article having a second exposed surface. The first and second exposed surfaces have first and second surface areas each for accepting one of the design pieces and one of the substrate layers. The first surface area has a first color, with the second surface area having a second color, different than the first color. The first and second substrate layers are made with different colors. A color of the first substrate layer is more compatible with the first color than with the second color. A color of the second substrate layer is more compatible with the second color than with the first color. Accordingly, the apparel items and substrate layers can be selectively color coordinated at time of attachment of the substrate layers to the apparel articles.

In one form, the thread on each of the first and second design pieces is woven to produce the first and second viewable designs.

The first apparel article may be one of a headwear piece or shirt. However, this is not limiting.

The first and second substrate layers may be made from a material that can be cut to produce perimeter edges that are not prone to noticeable fraying.

The first and second substrate layers may be made from a felt material.

In one form, the first and second thread sections may be defined by woven thread.

In one form, the perimeter edges of the first and second design pieces have shapes and sizes that are substantially the same and the perimeter edges of the first and second substrate layers likewise have shapes and sizes that are substantially the same.

In one form, the shapes of the perimeter edges of the substrate layers at least nominally conform to the shapes of the perimeter edges of the design pieces at least partially around the perimeter edges of the design pieces.

In one form, the shapes of the perimeter edges of the substrate layers at least nominally conform to the shapes of the perimeter edges of the design pieces substantially fully around the perimeter edges of the design pieces.

In another form, the invention is directed to the combination of: a first apparel article having a sheet layer defining a first exposed surface; a first design piece having thread that is formed to produce at least a part of a first viewable design and having a perimeter edge; and a second design piece having thread that is formed to produce at least a part of a second viewable design and having a perimeter edge. The first and second design pieces have a different appearance. The first and second viewable designs are substantially the same but are respectively formed at least in part with first and second thread sections of different color. Each of the first and second design pieces is selectively attachable to the first exposed surface of the apparel article.

The combination may further include a second apparel article with a second sheet layer defining a second exposed surface. The first and second exposed surfaces have first and second surface areas each for accepting one of the design pieces. The first surface area has a first color and the second surface area has a second color different than the first color. The color of the first thread section is more compatible with the first color than with the second color, with the color of the second thread section more compatible with the second color than with the first color. Accordingly, the apparel articles and design pieces can be selectively color coordinated at the time of attachment of the design pieces to the apparel articles.

In one form, thread on each of the first and second design pieces is woven to produce the first and second viewable designs.

In one form, the first apparel article is one of a headwear piece and a shirt. These are exemplary in nature only and are not limiting.

In one form, the first and second thread sections are defined woven thread.

The combination may further include first and second substrate layers each having a perimeter edge. The first and second design pieces are selectively usable, one each in conjunction with one of the design pieces, for attachment to the first exposed surface of the first apparel article.

In one form, the design pieces and substrate layers are selectively attachable to the first exposed surface of the first apparel article with a substrate layer captive between a design piece and the first exposed surface of the first apparel article.

In one form, the perimeter edges of the substrate layers have shapes and sizes that are substantially the same.

In one form, the substrate layers may have different colors.

The substrate layers may be made from a material that can be cut to produce perimeter edges that are not prone to noticeable fraying.

In one form, the first and second substrate layers are made from a felt material.

The invention is further directed to a method of applying adornment to an apparel article. In one form, the method includes the steps of: providing a first apparel article having a sheet layer defining a first exposed surface; providing a first design piece having woven thread that produces at least a part of a viewable design and having a perimeter edge; providing a second design piece having woven thread that produces at least a part of a second viewable design and having a perimeter edge, wherein the first and second design pieces have a different appearance and the first and second viewable designs are respectively formed in part with first and second thread sections of different colors; and at a first location a) storing the first and second design pieces, b) selecting one of the first and second design pieces that produces a desired appearance in conjunction with the first apparel article, and c) attaching the one of the first and second design pieces that is selected to the first apparel article.

The method may further include the steps of providing at the first location first and second substrate layers each having a perimeter edge and that are different in appearance and at the first location a) selecting one of the first and second substrate layers that produces a desired appearance in conjunction with the first apparel article and the one of the first and second design pieces that is selected and b) attaching i) the one of the first and second design pieces that is selected and ii) the one of the first and second substrate layers that is selected to the first apparel article with the one of the first and second substrate layers that is selected between the one of the first and second design pieces that is selected and the first apparel article.

In one form, the perimeter edge of the one of the first and second substrate layers that is selected extends beyond the perimeter edge of the one of the first and second design pieces that is selected so that a frame surface is defined at least partially around the perimeter edge of the one of the first and second design pieces that is selected.

The step of providing a first apparel article may involve providing one of a shirt and a headwear piece.

BRIEF DESCRIPTION OF THE DRAWINGS

FIG. 1 is a schematic representation of an apparel article, with ornamentation according to the present invention thereon, and consisting of a substrate layer with an attached design piece that define a patch;

FIG. 2 is an elevation view of the inventive ornamentation in FIG. 1 in the form of a rounded/circular patch;

FIG. 3 is a cross-sectional view of the ornamentation taken along lines 3-3 of FIG. 2;

FIG. 4 is a schematic representation of the ornamentation in FIGS. 1-3 and showing a generic connection between the design piece and substrate layer;

FIG. 5 is a perspective view of a headwear piece, representative of the apparel article in FIG. 1, and with ornamentation according to the invention in two different forms attached to the crown and brim/bill;

FIG. 6 is a plan view of a substrate layer upon which a plurality of design pieces are formed;

DETAILED DESCRIPTION OF THE DRAWINGS

Figure 7:
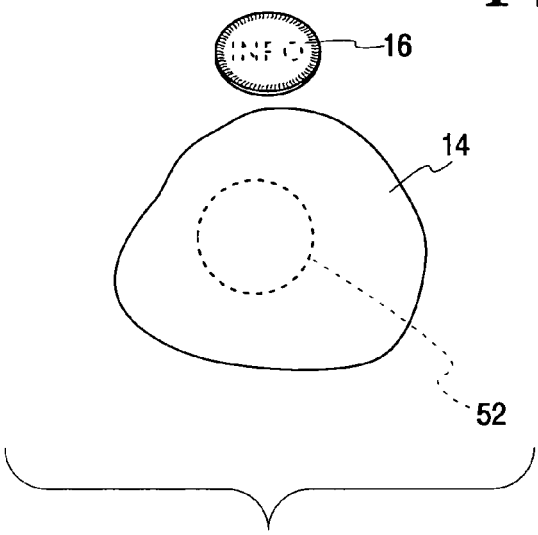
FIG. 7 is an exploded perspective view of a substrate layer to which the inventive design piece is attached.

In FIG. 1, an apparel article, according to the present invention, is shown at 10. The apparel article 10 is shown in a schematic form intended to encompass every conceivable apparel article, such as, but not limited to, headwear/hats, shirts, coats, pants, ties, shoes and socks, and accessories, such as purses, headbands, etc. Generally, the apparel article 10 has a sheet layer, to which ornamentation 12 according to the present invention is applied.

One form of the ornamentation 12 is shown additionally in FIGS. 2 and 3. The ornamentation 12 consists of a substrate layer 14 to which a design piece 16 is attached. In a preferred form, the design piece 16 is separately formed from the substrate layer 14. The design piece 16 has a separate substrate layer 18 to which thread 20 is applied to produce a viewable design, as shown at 22 in FIG. 2. The viewable design 22 is identified as "INFO", intended to generically encompass virtually a limitless number of different designs. For example, the design may be in the nature of a picture, a logo, words, numbers, etc. Regardless of the nature of the design, it is intended that the design convey some sort of information, either directly or indirectly.

The design piece 16 has a perimeter shape bounded by an edge 24. In this embodiment, thread 26 is wrapped/embroidered around the perimeter edge 24 to produce a raised bead that defines a border line 28. The substrate layer 14 may be any sheet layer, such as one made from fabric, plastic, leather, metal, etc. As shown in FIG. 4, the design piece 16 is attached to the substrate layer 14 through an appropriate connection 30, which may be stitching, an adhesive, or other means known to those skilled in the art. In the exemplary embodiment shown in FIGS. 2 and 3, an adhesive layer 30 is shown for the connection.

The substrate layer 14 has a perimeter edge 32 that is spaced uniformly from the perimeter edge 24 of the design piece 16, in this embodiment, fully around the design piece 16. This produces an exposed, annular frame surface 34 around the design piece 16 upon which additional information, shown generically at 36, can be applied. In this embodiment thread 38 is used to define the information 36. Again, the nature of the information 36 is not limited in any manner.

A separate thread 40 is wrapped/embroidered around the perimeter edge 32 to define a raised bead 42 which defines a surrounding line. The bead/surrounding line 42 might alternatively be spaced inwardly from the perimeter edge 32. The information 36 is shown applied in a curved shape corresponding to that between the lines 28, 42.

The combined design piece 16 and substrate layer 14 define a patch at 44 that can be applied to an exposed surface of the apparel article 10 through an appropriate connection 46. The connection 46 may be in the form of thread, an adhesive, or other means, known to those skilled in this art, which facilitates attachment to the apparel article 10.

In a preferred form, the viewable design 22 on the design piece 16 is formed by weaving the thread 20. This permits high quality, detailed information to be formed for the viewable design 22. However, a virtually unlimited number of other methods of forming this information are contemplated. As one example, the information 22 may be in the nature of a logo, a picture, a representation of a place, location or event, etc. The information 36 preferably relates to the information 22. Thread 38 defining the information 36 may be applied as by using conventional embroidery techniques, or by any other means known to those skilled in this art.

As examples of the coordination between the information 22, 36, the information 22 may be a team logo. The information 36 may be a word identification associated with that team. As a further example, the information 22 may relate to an event or an organization, with the information 36 more specifically describing something associated with that organization or event. The information 22 might be a logo for a particular golf venue, with the information 36 identifying a tournament that is played a particular year. Alternatively, the information 22 may identify a competition, with the information 36 identifying an aspect of the competition, which may be its location, the entities competing, etc.

In this embodiment, the perimeter shapes of the design piece 16 and substrate layer 14 correspond and are round. The border line 28 and surrounding line 42 are circular and concentric. It is not necessary, however, that the peripheral shapes of the design piece 16 and substrate layer 14 be corresponding, or that they be circular in shape. The circular shape is selected for its aesthetic appeal.

In FIG. 5, an exemplary apparel article 10' in the form of headwear piece is shown with a patch 44' applied to an exposed surface 48 of a crown 50. The patch 44' consists of a substrate layer 14' to which a design piece 16' is applied. The design piece 16' has information 22' thereon, with the surrounding substrate layer 14 having information 36' thereon. In this embodiment, the substrate layer 14 has a random shape, with the design piece 16' having a non-conforming shape.

As a further alternative, as shown in FIG. 5, a patch 44" is shown applied to a brim/bill 51 with a substrate layer 14" having a triangular shape, with the design piece 16" having a conforming shape and applied thereto. The design piece 16" has information 22" applied thereto, with the substrate layer 14" having information 36" applied thereto.

The ornamentation 12 lends itself to being manufactured in a number of different ways. As shown in FIG. 6, the substrate layer 18 may be defined as a sheet with an area that is substantially greater than that of the design piece 16. The design piece 16 may be formed on the substrate layer 18 and subsequently cut therefrom. The design piece 16 can then be combined with the substrate layer 14 in any of a number of different ways. Three exemplary ways are shown in FIGS. 7-9.

In FIG. 7, a continuous sheet of the substrate layer 14 is provided to which the design piece 16 is applied. Thereafter, the substrate layer 14 is cut, as at the line 52, to produce the desired overall shape for the resulting patch 44.

Figure 8:
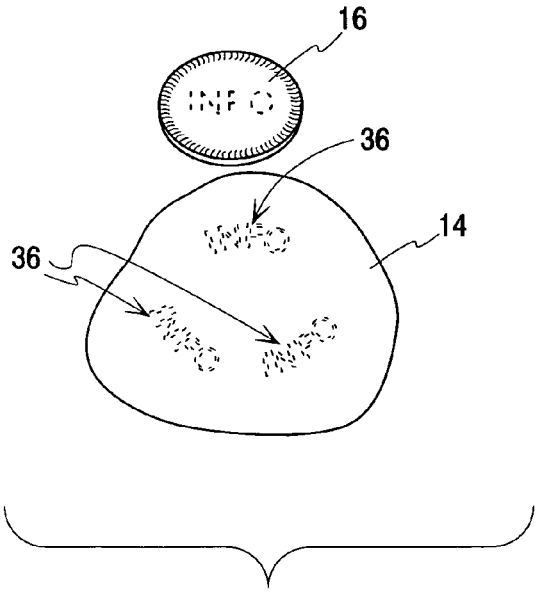
FIG. 8 is a view as in FIG. 7 wherein information is applied to the substrate layer before the design piece is attached thereto.

In FIG. 8, the information 36 is applied to the substrate layer 14 with the substrate layer 14 in continuous sheet form. The substrate layer 14 can then be cut to produce the desired outline for the patch.

Figure 9:
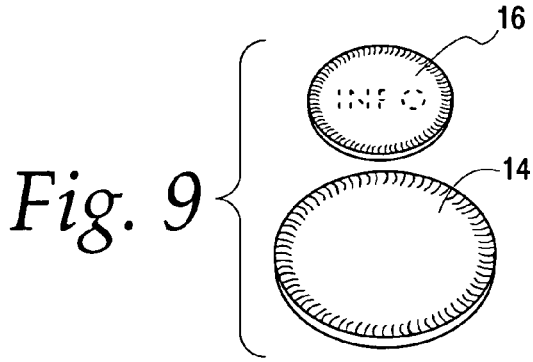
FIG. 9 is a view as in FIGS. 7 and 8 wherein the substrate layer is cut to an end size before the design piece is attached thereto.

As a further alternative, as shown in FIG. 9, the substrate layer 14 is pre-cut to the desired end patch shape, after which the design piece 16 is applied. The information 36 may be applied to the substrate layer 14 before or after application of the design piece 16.

Other variations of these methods are contemplated.

Figure 10:
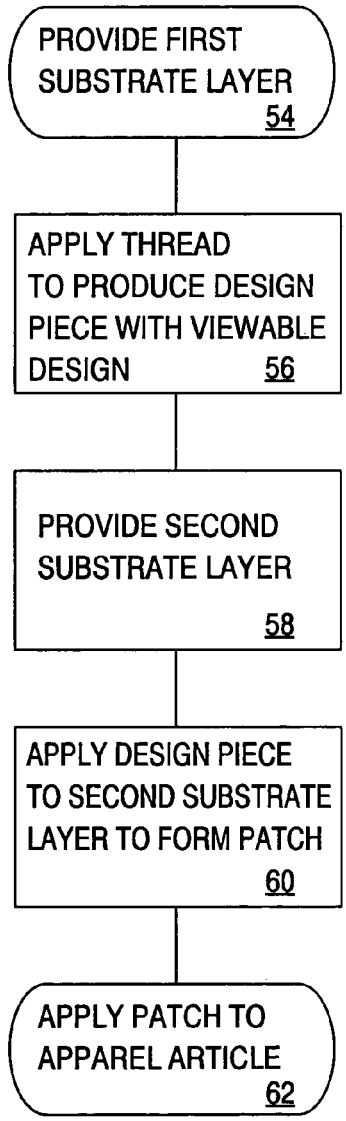
FIG. 10 is a flow diagram representation of a method of producing ornamentation for an apparel article, according to the invention.

A generic form of method for producing ornamentation on an apparel article is shown in FIG. 10 in flow diagram form. As shown at block 54, a first substrate layer is provided. As shown at block 56, thread is applied to produce a design piece with a viewable design. A second substrate layer is provided as shown at block 58. The design piece is applied to the second substrate layer to form a patch, as shown at block 60. As shown at block 62, the patch is applied to the apparel article.

It is also contemplated that each patch 44 could be attached to an apparel article 10 in a manner to be separable therefrom, as described in co-pending U.S. application Ser. No. 10/726,877, entitled "Method of Adorning an Article and an Adorned Article Made Using the Method", which is incorporated herein by reference. To accomplish this, the connection 46 may be effected by spot stitching or virtually any other type of sewing or stitching that allows the thread to be cut to separate the patch 44. The patch 44 can be replaced with another patch at the same or different location on an apparel article. This allows the method in application Ser. No. 10/726,877 to be practiced, whereby customers can remove and replace ornamentation as dictated by an event, or otherwise by a particular demand.

Figure 11:
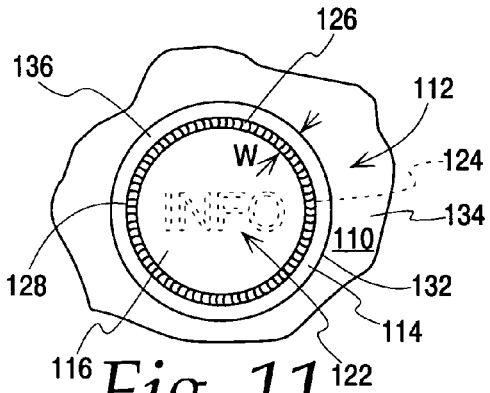
FIG. 11 is a fragmentary, elevation view of an apparel article with a further modified form of ornamentation, according to the present invention, including a design piece fixed in relationship to a substrate layer.
Figure 12:
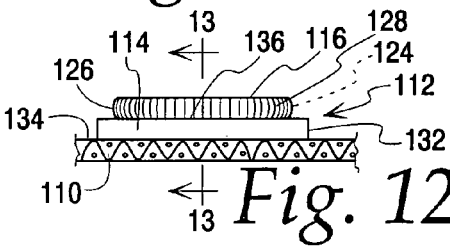
FIG. 12 is a view of the ornamentation, as in FIG. 11, and viewed from a perspective turned 90° from that in FIG. 11.
Figure 13:
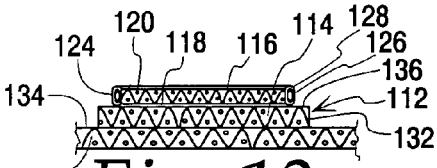
FIG. 13 is a cross-sectional view of the ornamentation on the apparel article taken along line 13-13 of FIG. 12.

Variations of the inventive structure are shown in FIGS. 11-23. Referring initially to FIGS. 11-13, an apparel article 110 is shown having ornamentation 112. The ornamentation 112 consists of a substrate layer 114 and a design piece 116, separately formed from and attached in relationship to the substrate layer 114. The design piece 116 may be applied over the substrate layer 114 or may be fixed in a complementarily-shaped opening therein.

The design piece 116 may be formed in the same manner as any of the design pieces 16, 16', 16", described above. That is, the design piece 116 has a second substrate layer 118 to which thread 120 is woven to produce a viewable design 122, identified generically as "INFO" in FIG. 11. The design piece 116 has a perimeter edge 124 about which thread 126 is wrapped/embroidered to produce a bead/borderline 128. The bead/borderline 128 is optional. The structure for connecting the design piece 116 to the substrate layer 114 is not shown in detail in FIGS. 11-13, but could take any form, described above, or any other form well known to those skilled in this art.

The substrate layer 114 has a perimeter edge 132, which in this embodiment is shown without a bead/borderline formed by wrapped/embroidered thread. The substrate layer 114 is suitably applied to an exposed surface 134 on the apparel article 110 through an appropriate means including, but not limited to, those described above.

In this embodiment, the perimeter edge 124 of the design piece 116 lies fully within the perimeter edge 132 of the substrate layer 114. By reason of the substrate layer 114 extending beyond the perimeter edge 124 of the design piece 116, a frame surface 136 is defined, in this case fully around the perimeter edge 124 of the design piece 116. As explained in detail below, the perimeter edge 132 of the substrate layer 114 has a shape that at least nominally conforms to the shape of the perimeter edge 124 of the design piece 116 at least partially around the perimeter edge 124 of the design piece 116. In this embodiment, there is substantial conformity around the entire peripheral extent of the perimeter edge 124.

By reason of the conformity of the perimeter edges 124, 132, the frame surface 136 has a uniform width W (FIG. 11). The width W is controlled to produce a unique highlighting of the viewable design 122 on the design piece 116, without diminishing the effect thereof. By controlling the width W to a dimension in the range of 1/16 to 3/4 inches, and more preferably 1/16 to 1/4 inch, a shadowing/highlighting effect can be realized so as to accent, but not dominate, the viewable design 122. The provision of information on the frame surface 136 is optional. With a smaller width W, it may be preferred to not have information thereon.

To facilitate the formation of a sharp perimeter edge 132, the substrate layer 114 may be made from a material that does not fray when it is cut. For example, the substrate layer 114 may be made from a felt material that may be color coordinated to enhance the combined appearance of the substrate layer 114 and the design piece 116.

Figure 14:
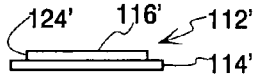
FIG. 14 is a view as in FIGS. 12 and 13 of a modified form of ornamentation, according to the invention, including a design piece and substrate layer, having a different construction than that shown in FIGS. 11-13.

The substrate layer 114 can be made from virtually any type of material to provide support for, and contrast with, the design piece 116. For example, as shown for the ornamentation 112' in FIG. 14, the substrate layer 114' is shown generically to represent other materials, which may be metal, plastic, a composite, or the like. In FIG. 14, a design piece 116' is shown with a perimeter edge 124' lacking a bead/borderline corresponding to that shown at 128 in FIGS. 11-13.

Figure 15:
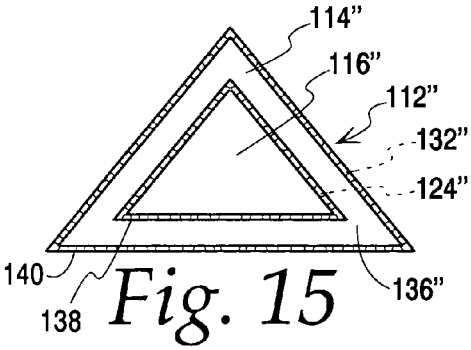
FIG. 15 is an elevation view of a further modified form of ornamentation, according to the invention, and having a conformingly shaped design piece and substrate layer with a different shape than shown on the ornamentation in FIGS. 11-13.

In FIG. 15, ornamentation 112" is shown with a triangularly-shaped design piece 116" and a complementarily-shaped substrate layer 114". The perimeter edges 124", 132" of the design piece 116" and substrate layer 114", respectively, are oriented so that the frame surface 136" has a uniform width fully around the perimeter of the design piece 116". Beads/borderlines 138, 140 are defined by wrapped/embroidered thread around the perimeter edges 132", 134", respectively.

Figure 16:
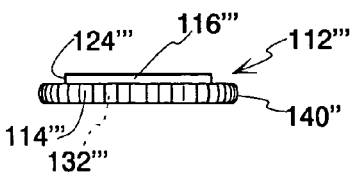
FIG. 16 is a view corresponding to that in FIG. 14 wherein the substrate layer has a different configuration than the substrate layer on the design piece in FIG. 14.

In FIG. 16, ornamentation 112''' is shown with a design piece 116''' having a perimeter edge 124''' without any bead/borderline. In this embodiment, the perimeter edge 132''' of the substrate layer 114''' is wrapped/embroidered with thread to produce a bead/borderline 140'''.

Figure 17:
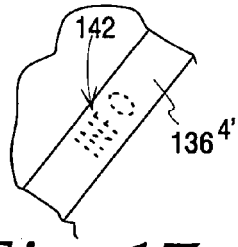
FIG. 17 is a fragmentary, elevation view of ornamentation, according to the invention, and showing a portion of a design piece in relationship to a substrate layer defining a frame surface with information thereon.
Figure 18:
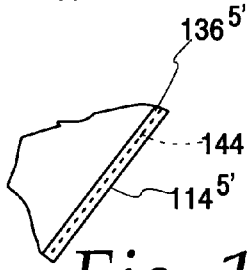
FIG. 18 is a view as in FIG. 17 wherein the frame surface has a narrower width and stitching applied therethrough.
Figure 19:
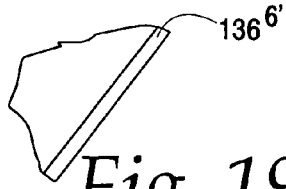
FIG. 19 is a view as in FIG. 18 with there being no stitching through the frame surface.

In FIGS. 17-19, different frame surface configurations are shown at $\mathbf{136}^{4'}$, $\mathbf{136}^{5'}$, $\mathbf{136}^{6'}$, consecutively. The frame surface $\mathbf{136}^{4'}$ has information 142 thereon that is independent of, or related to, any information on an associated design piece (not shown). The frame surface $\mathbf{136}^{4'}$ has a greater width than the corresponding frame surfaces $\mathbf{136}^{5'}$ and $\mathbf{136}^{6'}$ in FIGS. 18 and 19. The frame surface width shown in FIGS. 18 and 19 is at the lower end of a preferred range and in FIG. 18 is shown to have a sufficient dimension to receive a line of stitching 144 which may be used to attach the substrate layer $\mathbf{114}^{5'}$ to the apparel article 110. In FIG. 19, a corresponding width is shown for the frame surface $\mathbf{124}^{6'}$, without any stitching as in FIG. 18.

Figure 20:
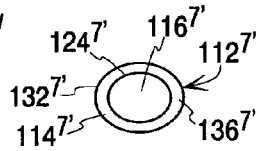
FIG. 20 is a view corresponding to that in FIG. 15 of a modified form of ornamentation, according to the invention, and having a rounded/elliptically-shaped design piece and substrate layer.

In FIG. 20, ornamentation is shown at $\mathbf{112}^{7'}$ having a rounded/elliptical design piece $\mathbf{116}^{7'}$ and a complementarily-shaped substrate layer $\mathbf{114}^{7'}$. FIG. 20 is intended to represent generically any ornamentation $\mathbf{112}^{7'}$ with design pieces $\mathbf{116}^{7'}$ and substrate layers $\mathbf{114}^{7'}$ having round or rounded perimeter edges $\mathbf{124}^{7'}$, $\mathbf{132}^{7'}$, respectively. The rounded shapes may vary significantly from round or elliptical and may be such as to produce a uniform or non-uniform width for the frame surface $\mathbf{136}^{7'}$.

Figure 21:
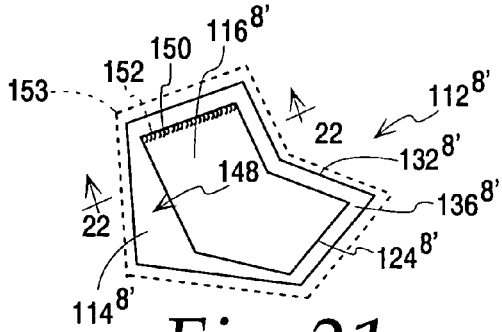
FIG. 21 is a view as in FIGS. 15 and 20 of a further modified form of ornamentation, according to the invention, and having a substrate layer corresponding in shape to a design piece only partially around a perimeter edge of the design piece.
Figure 22:
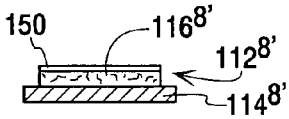
FIG. 22 is a cross-sectional view of the ornamentation taken along line 22-22 of FIG. 21.

As an alternative to a rounded shape, in FIGS. 21 and 22, ornamentation $\mathbf{112}^{8'}$ is shown with a random perimeter shape. A design piece $\mathbf{116}^{8'}$ is attached in relationship to a substrate layer $\mathbf{114}^{8'}$. The design piece $\mathbf{116}^{8'}$ has a perimeter edge $\mathbf{124}^{8'}$ with a shape that nominally conforms to the shape of a substantial part of the periphery of the perimeter edge $\mathbf{132}^{8'}$ of the substrate layer $\mathbf{114}^{8'}$. In this embodiment, the frame surface $\mathbf{136}^{8'}$ has a width that is substantially uniform around a substantial portion of the perimeter edge $\mathbf{124}^{8'}$. In the region at 148, the width of the frame surface $\mathbf{136}^{8'}$ changes significantly.

In one form, it is preferred that there be general conformity in the shape of the perimeter edges of the design pieces and substrate layers through at least 180° with respect to a circle circumscribing the ornamentation. However, exact or nominal conformity is not a requirement.

In FIGS. 21 and 22, the substrate layer 114$^{8'}$ is shown as a solid piece of metal or other material, with the overlying design piece 116$^{8'}$ having a bead/borderline 150 along one portion 152 of perimeter edge 124$^{8'}$.

Optionally, in all embodiments, an additional one, or more, substrate layers, shown in dotted lines at 153 in FIG. 21, may be provided with a perimeter shape either having a non-conforming shape, or partially or fully conforming to the perimeter shape of the overlying substrate layer 114$^{8'}$ and/or design piece 116$^{8'}$.

Figure 23:
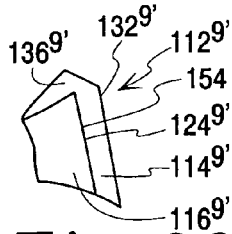
FIG. 23 is a view as in FIGS. 15, 20 and 21 of a further modified form of orientation, according to the invention, wherein the frame surface does not extend fully around the design piece.

In FIG. 23, a further modified form of ornamentation is shown at 112$^{9'}$ consisting of a design piece 116$^{9'}$ in relationship to a substrate layer 114$^{9'}$. The perimeter edge 124$^{9'}$ of the design piece 116$^{9'}$ conforms to the perimeter edge 132$^{9'}$ along only one portion 154 of the perimeter edge 124$^{9'}$. Elsewhere, the frame surface 136$^{9'}$ has a random width. Additionally, the ornamentation 112$^{9'}$, is configured so that the frame surface 136$^{9'}$ extends only partially around the perimeter edge 124$^{9'}$ of the design piece 116$^{9'}$.

Figure 24:
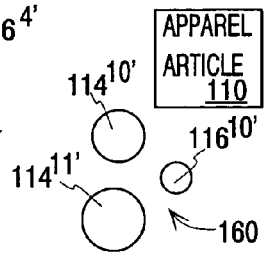
FIG. 24 is a partially schematic representation of a kit to provide ornamentation on an apparel article by selecting between different substrate layers that are usable in combination with a design piece.

The invention also contemplates the provision of a kit, as shown at 160 in FIG. 24. The kit 160 consists of the apparel article 110, a design piece 116$^{10'}$, representative of all variations heretofore described and others, and two or more, and in this case two, separate substrate layers 114$^{10'}$, 114$^{11'}$. The substrate layer 114$^{10'}$ has a different appearance than the substrate layer 114$^{11'}$, by reason of a difference in shape, material, color, texture, etc. At the time of applying ornamentation, the user can form the design piece 116$^{10'}$ and fix the same in relationship to a selected one of the substrate layers 114$^{10'}$, 114$^{11'}$ that produces the desired appearance. The relationship between the design piece 116$^{10'}$ and the substrate layers 114$^{10'}$, 114$^{11'}$ may correspond to those described above, or may be different as preference dictates.

In one preferred form, the perimeter edges of the various design pieces are circumscribed by a circle with a first diameter. The associated substrate layers are circumscribed by a second circle having a second diameter. The second diameter is preferably not more than 1.5 times the first diameter. When no information is provided on the associated frame surface, the frame surface produces an accentuation of the design piece without domination thereof.

Figure 25:
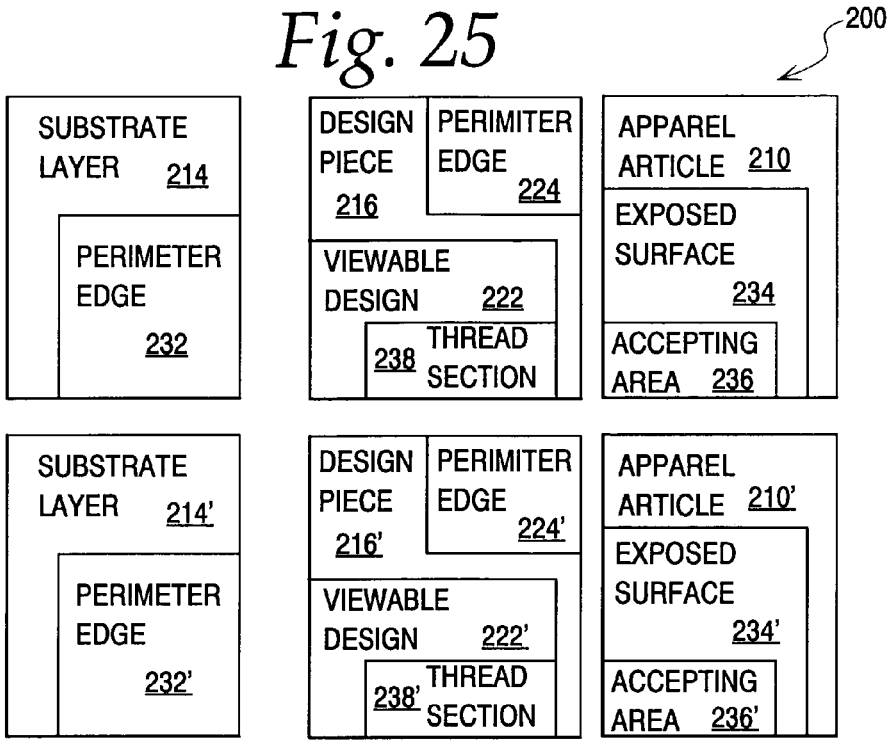
FIG. 25 is a schematic representation of a kit/combination, including substrate layers and design pieces, that can be selectively combined and attached to apparel articles to coordinatingly produce ornamentation on the apparel articles.
Figure 26:
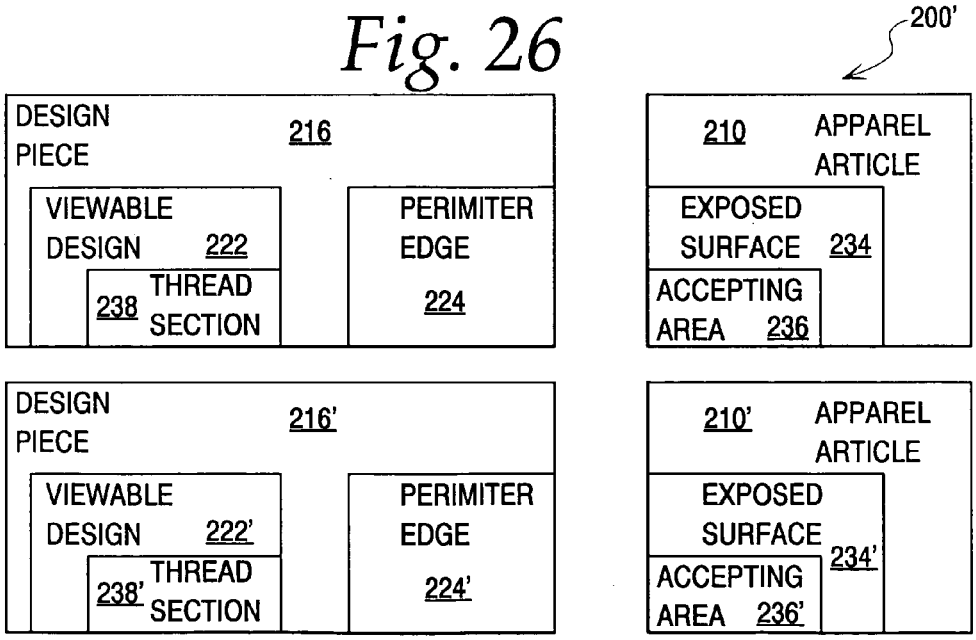
FIG. 26 is a view as in FIG. 25 wherein the apparel articles are adorned without the requirement of a substrate layer.

Another aspect of the invention is shown schematically in FIGS. 25 and 26. In each of these Figures, elements are shown in generic form to encompass all of the different variations heretofore described. Generally, elements identified in FIGS. 25, and 26, corresponding to those previously described, will be identified with like reference numerals with the addition of "200" to each designation.

Referring initially to FIG. 25, a kit/combination is shown at 200 consisting of a plurality of, and in this case two, exemplary apparel articles 210, 210', a plurality of, and in this case two, substrate layers 214, 214', and a plurality, and in this case two, design pieces 216, 216'. The design pieces 216, 216' have viewable designs 222, 222', respectively, thereon. The design pieces 216, 216' have perimeter edges 224, 224', respectively, with substrate layers 214, 214' having perimeter edges 232, 232', respectively.

The apparel article 210 has an exposed surface 234 with an area 236 thereon for accepting ornamentation. The apparel article 210' has a like exposed surface 234' with an area 236' for accepting ornamentation. As previously described, the exposed surfaces 234, 234' may be defined by a sheet layer, or otherwise.

At least a section 238 of the viewable design 222 is defined by thread, which is preferably woven to provide potentially sharp detail. The viewable design 222' is likewise formed from thread at a section 238'.

In one form of the invention, the apparel articles 210, 210' are of the same nature, though this is not a requirement. For example, the apparel articles 210, 210 may be shirts. The exposed surfaces 234, 234' have at least portions thereof that are different from each other in color. In most situations, the difference in color will be present in the areas 236, 236'. In one form, the design pieces 216, 216' have substantially the same viewable design 222, 222', with there being a difference in color between the viewable designs 222, 222' at the thread sections 238, 238'. Thus, the difference in thread color accounts for a different appearance for the separate design pieces 216, 216'.

The substrate layers 214, 214' may be made from the same or a different material. The perimeter edges 232, 232' thereof may be the same or different in shape and/or size. In one preferred form, the perimeter edges 232, 232' have substantially the same shape and size.

In one form, the substrate layers 214, 214' are made from a material that is not prone to fraying upon being cut. A suitable cloth material is felt. Other materials, including plastic, leather, metal, etc., could be used. The substrate layers 214, 214' may have the same or a different color.

While the substrate layers 214, 214' have been described to be made from material that is not prone to fraying, the invention does contemplate other cloth materials that tend to fray. In that event, the fraying may remain exposed or may be controlled, as by edge stitching, or the like.

According to the invention, at the time of applying ornamentation, consisting of one of the substrate layers 214, 214' and one of the design pieces 216, 216' for each apparel article 210, 210', the substrate layers 214, 214' and design pieces 216, 216' are selected to color coordinate at least the thread sections 238, 238' thereon with the exposed surfaces 234, 234' of the apparel articles 210, 210' at the exposed surfaces 234, 234'. For example, the exposed surfaces 234, 234' may have different colors, at least in the areas 236, 236' thereof. The color of the thread section 238 may be more compatible with the color of the exposed surface 234 at the accepting area 236 than with the exposed surface 234' at the accepting area 236'. Accordingly, this design piece 216 would be selected for application to the apparel article 210.

Likewise, the color of the thread section 238' may be more compatible with the color of the exposed surface 234' at the accepting area 236' than with the exposed surface 234 at the accepting area 236. Thus, the design piece 216' would be selected for attachment to the apparel article 210'.

While two of each of the design pieces 216, 216' and apparel articles 210, 210' are shown, any number of these pieces/articles and variations in color and design thereon are contemplated. Two versions of each are used herein strictly for purposes of explaining the basic inventive concepts.

The substrate layers 214, 214' may be the same in color, shape and size. Alternatively, the substrate layers 214, 214' may differ in one or all of these respects. To apply the ornamentation, an appropriate selection is made from the different available substrate layers 214, 214' and design pieces 216, 216' for each of the apparel articles 210, 210'. As described above, each selected design piece 216, 216' with the kit 200 is attached to a particular exposed surface 234, 234' in the same manner and so that a selected one of the substrate layers 214, 214' extends beyond the perimeter edge 224, 224' of a selected one of the design 216, 216'. This causes a frame section, as heretofore described, to be produced at least partially around the perimeter edge 224, 224' of the selected one of the design pieces 216, 216'. As previously noted, the design pieces 216, 216' and substrate layers 214, 214' can be attached in different manners, all within the scope of the present invention.

The invention also contemplates that the design pieces 216, 216' could be the same in appearance and that the substrate layers 214, 214' have a different appearance to be selected for application based on compatibility with the appearance of the particular exposed surface 234, 234' on the apparel article 210, 210'.

Thus, the invention contemplates coordinated application of a) the substrate layers 214,214' and apparel articles 210, 210'; b) the design pieces 216, 216' and the apparel articles 210, 210'; and c) the substrate layers 214, 214', design pieces 216, 216' and apparel articles 210, 210'.

While in a preferred form, the invention contemplates that a frame surface be defined by the substrate layers 214, 214' exposed beyond the perimeter edges 224, 224' of the design pieces 216, 216', the perimeter edges 232, 232' of the substrate layers 214, 214' may be substantially the same as the perimeter edges 224, 224' of the design pieces 216, 216' so that only the thickness of the perimeter edges 232, 232' of the substrate layers 214, 214' is visible at the exposed surfaces 234, 234'.

Coloring can be such that the color of the substrate layers 214, 214' is the same as the color of the adjacent portions of the design pieces 216, 216', or so as to contrast therewith.

In another variation, as shown in FIG. 26, a kit/combination is provided at 200' consisting of the components as in FIG. 25, with the exclusion of the substrate layers 214, 214'. The design pieces 216, 216' and apparel articles 210, 210' are assembled with color coordination in mind as for the kit/combination 200.

The invention contemplates other variations, such as one wherein additional components, such as an additional substrate layer, might be utilized.

According to the invention, individual design pieces 216, 216' can be woven, to be potentially identical but for thread color, over some or all of the visible area thereof. The application of the design pieces, 216, 216' can be carried out as in a factory, by a distributor, or at site of sale.

The foregoing disclosure of specific embodiments is intended to be illustrative of the broad concepts comprehended by the invention.

The invention claimed is:

1. A method of applying adornment to an apparel article, the method comprising the steps of:

providing a first apparel article comprising a sheet layer defining a first exposed surface;

providing a first design piece comprising woven thread that produces at least a part of a viewable design and having a perimeter edge;

providing a second design piece comprising woven thread that produces at least a part of a second viewable design and having a perimeter edge, the first and second design pieces having a different appearance, the first and second viewable designs substantially the same but are respectively formed in part with first and second thread sections of different color;

at a first location a) storing the first and second design pieces, b) selecting one of the first and second design pieces that produces a desired appearance in conjunction with the first apparel article, and c) attaching the one of the first and second design pieces that is selected to the first apparel article; and providing at the first location first and second substrate layers each having a perimeter edge and that are different in appearance and at the first location a) selecting one of the first and second substrate layers that produces a desired appearance in conjunction with the first apparel article and the one of the first and second design pieces that is selected and b) attaching i) the one of the first and second design pieces that is selected, and not the other of the first and second design pieces, and ii) the one of the first and second substrate layers that is selected, and not the other of the first and second substrate layers, to the first apparel article with the one of the first and second substrate layers that is selected located between the one of the first and second design pieces that is selected and the first apparel article.

2. The method for applying adornment to an apparel article according to claim 1 wherein the perimeter edge of the one of the first and second substrate layers that is selected extends beyond the perimeter edge of the one of the first and second design pieces that is selected so that a frame surface is defined at least partially around the perimeter edge of the one of the first and second design pieces that is selected.

3. The method for applying adornment to an apparel article according to claim 1 wherein the step of providing a first apparel article comprises providing one of a shirt and a headwear piece.

* * * * *